US007927120B1

(12) United States Patent
Wang et al.

(10) Patent No.: US 7,927,120 B1
(45) Date of Patent: Apr. 19, 2011

(54) CONNECTOR

(75) Inventors: Hung-Chi Wang, Taipei (TW); Ning-Lang Cheng, Taipei (TW); Mei-Chuan Yang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/948,989

(22) Filed: Nov. 18, 2010

(51) Int. Cl.
*H01R 13/62* (2006.01)

(52) U.S. Cl. ..... 439/328

(58) Field of Classification Search ..... 439/326–328
See application file for complete search history.

(56) References Cited

U.S. PATENT DOCUMENTS 6,634,900 B2 * 10/2003 Hu et al. ..... 439/328

* cited by examiner

*Primary Examiner* — Tho D Ta
(74) *Attorney, Agent, or Firm* — WPAT, P.C.; Anthony King

(57) ABSTRACT

A connector has an insulating housing of which two opposite ends extended frontward to form a pair of supporting arms, terminals mounted in the insulating housing having soldering portions projected out of a bottom of the insulating housing, a positioning member. The positioning member has a base slice received in a through slot formed at the supporting arm. A top slice and a bottom slice are extended from top and bottom edges of the base slice respectively and perpendicular to the base slice. The top slice is located above a top of the supporting arm, the bottom slice is located under a bottom of the supporting arm for being soldered on the PCB. As the height of the base slice is bigger than that of the through recess, intervals are accordingly formed between the supporting arm and positioning member to achieve an up-and-down movement of the positioning member.

6 Claims, 2 Drawing Sheets

CONNECTOR

BACKGROUND OF THE INVENTION

1. Field of the Invention

The present invention relates to a connector, and more particularly to a connector capable of ensuring a steady connection between terminals thereof and a printed circuit board (PCB).

2. The Related Art

FIG. 3 shows a conventional connector 100' soldered on a PCB. The connector 100' has an insulating housing 10', a plurality of first terminals 20' and second terminals 30' mounted in the insulating hosing 10' and each having a soldering portion (not labeled) for being soldered on the PCB, and a pair of fixing members 40' protruded forward from two opposite ends of a front of the insulating housing 10'. Bottoms of the fixing members 40' extend towards each other to form positioning portions 41' soldered on the PCB. However, as the positioning portion 41' is molded with the fixing member 40' together, the soldering portions of the terminals 20', 30' may not be level with the positioning portions 41'. As a result, there may be some soldering portions failing to be soldered with the PCB, and a poor connection is caused between the connector 100' and the PCB.

SUMMARY OF THE INVENTION

Accordingly, an object of the present invention is to provide a connector for being soldered on a PCB. The connector has an insulating housing, a plurality of terminals assembled in the insulating housing, a positioning member. The insulating housing has a base of which two opposite ends extend frontward to form a pair of supporting arms. The supporting arm defines a through slot vertically penetrating through a top and a bottom thereof. The terminal has a soldering portion projecting out of a bottom of the base for being soldered on the PCB. The positioning member movably mounted to the supporting arm has a base slice received in the through slot. A top slice and a bottom slice are extended from top and bottom edges of the base slice respectively and perpendicular to the base slice. The top slice is located on the top of the supporting arm and the bottom slice is located under the bottom of the supporting arm for being soldered on the PCB. As the base slice has a bigger height than that of the through slot, intervals are accordingly formed between the supporting arm and the positioning member to achieve an up-and-down movement of the positioning member, so as to adjust a relative position between the PCB and the soldering portions of the terminals.

As described above, the top slice is located above the top of the supporting arm, the bottom slice is soldered on the PCB. As there are intervals between the positioning member and the supporting arm, it allows an up-and-down movement of the supporting arm in a vertical direction so as to adjust a relative position of the PCB and the soldering portions of the terminals. Also, the connector is able to keep the bottom of the terminal be level with the bottom slice even when there is tolerance in production.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
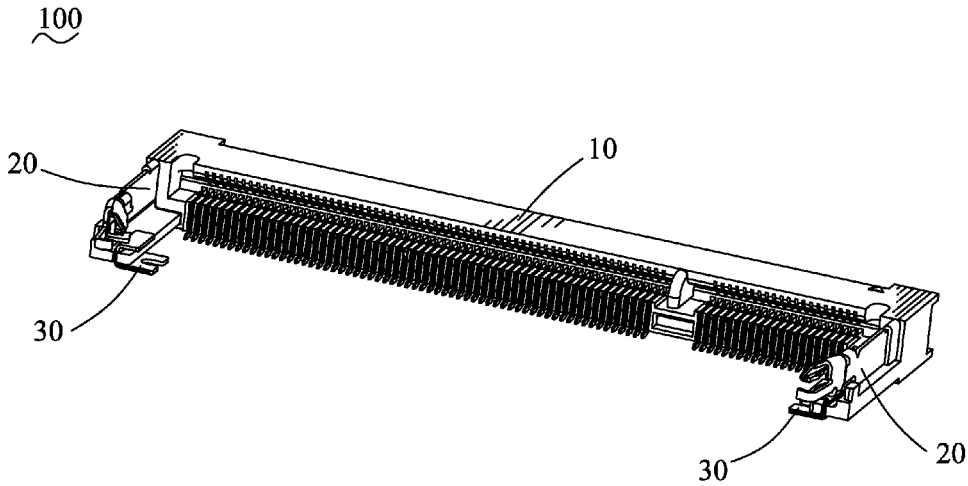
FIG. 1 is an assembled, perspective view of a connector of an embodiment in accordance with the present invention.
Figure 2:
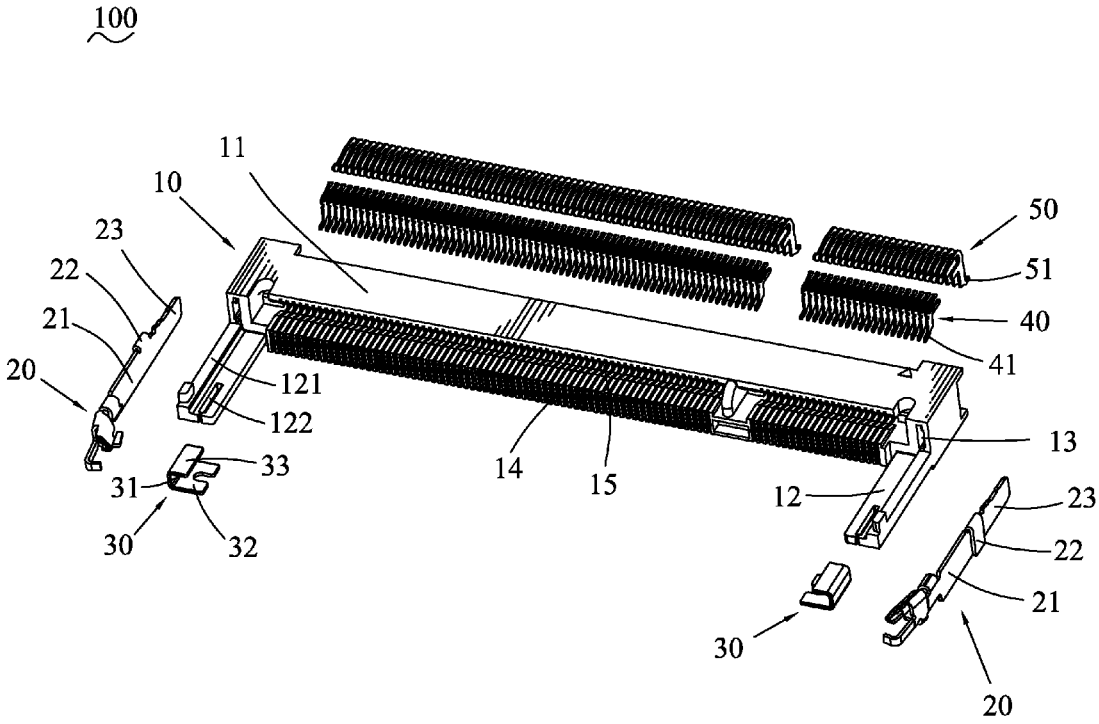
FIG. 2 is an exploded, perspective view of the connector shown in FIG. 1.
Figure 3:
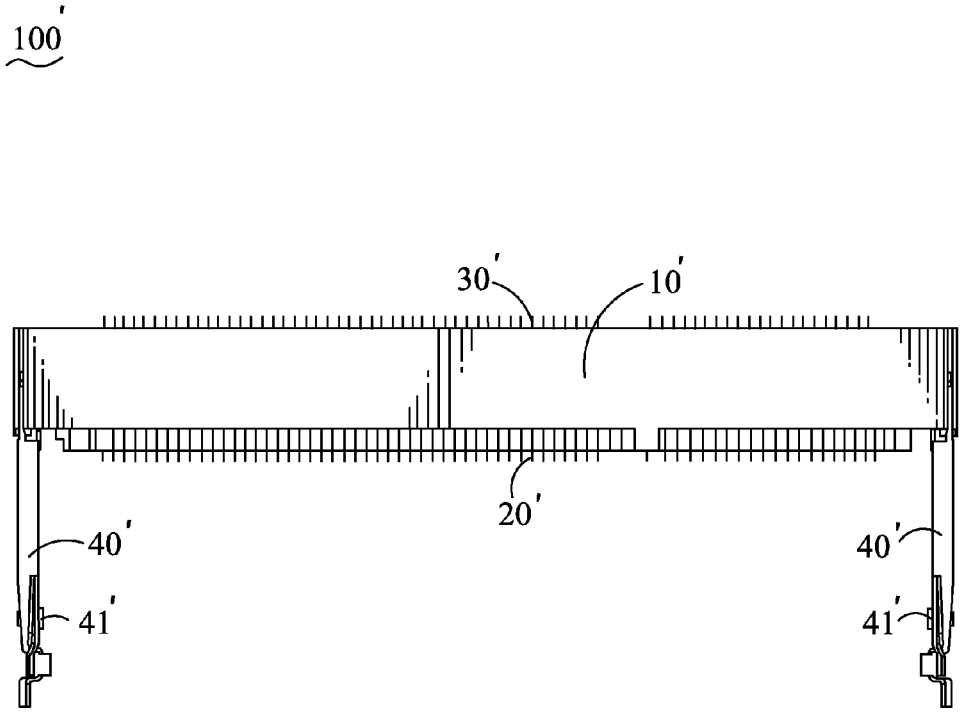
FIG. 3 (Prior Art)
FIG. 3 is a perspective view showing a conventional connector.

Referring to the drawings in greater detail, and first to FIGS. 1-2, the embodiment of the invention is embodied in a connector 100. The connector 100 has an insulating housing 10, a plurality of first terminals 40 and second terminals 50 mounted in the insulating housing 10, a pair of latch members 20 assembled to two opposite ends of the insulating housing 10, and a pair of positioning members 30 movably mounted to the two opposite ends of the insulating housing 10.

With reference to FIGS. 1-2, the insulating housing 10 has a long rectangular base 11. A lower part of a front of the base 11 defines a plurality of first terminal grooves 14 arranged at regular intervals along a longwise direction thereof. An upper portion of the base 11 defines a plurality of second terminal grooves 15 arranged at regular intervals along the longwise direction thereof and each extending frontward and rearwards to penetrate through the base 11. The front of the base 11 has two opposite ends extended frontward to form a pair of supporting arms 12 having bottoms substantially level with that of the base 11. A front side of the supporting arm 12 is recessed rearward to form a through slot 122 vertically penetrating a top and the bottom of the supporting arm 12. An outside of the top of the supporting arm 12 is protruded upward to form a protrusion platform 121 extending along the extension direction of the supporting arm 12. The two opposite ends of the front of the base 11 are further recessed rearward to form a pair of fixing recesses 13 each having a bottom side level with a top of the protrusion platform 121.

The first terminals 40 are disposed in the corresponding first terminal grooves 14 of the insulating housing 10, and each has a first soldering portion 41 projecting out of the bottom of the base 11 for being soldered with a PCB (not shown). The second terminals 50 are respectively disposed in the second terminal grooves 15 of the insulating housing 10, and each has a second soldering portion 51 projecting out of the bottom of the base 11 for being soldered with the PCB.

The latch member 20 has a long rectangular base plate 21. A rear edge of the base plate 21 extends rearward to form a fixing portion 23. A portion of a top edge of the base plate 21 adjacent to the fixing portion 23 is bent outward and then extends downward to form a folded plate 22 apart facing the base plate 21.

The positioning member 30 has a base slice 31 having a bigger height than that of the through slot 122 of the insulating housing 10. A top of the base slice 31 is extended perpendicularly to the base slice 31 to form a top slice 33. A bottom of the base slice 31 is extended toward the same direction as the top slice 33 to form a bottom slice 32 parallel with the top slice 33.

In assembly, the fixing portion 23 of the latch member 20 is inserted rearward into the fixing recess 13 until the folded plate 22 rests against the front of the base 11 to prevent the latch member 20 further going into the insulating housing 10. At this time, the base plate 21 of the latch member 20 is supported by the protrusion platform 121. The positioning member 30 is movably mounted in the supporting arm 12 with the base slice 31 received in the through slot 122. The top slice 33 is disposed on the supporting arm 12, the bottom slice 32 is located under the supporting arm 12. The bottom slices 32 are used to be soldered on the PCB. As the height of the base slice 31 is bigger than that of the through slot 122, intervals are accordingly formed between the positioning member 30 and the supporting arm 12, as a result, the positioning member 30 is capable of moving up-and-down.

As described above, the base slice 31 of the positioning member 30 is received in the through slot 122, the top slice 33 is located above the top of the supporting arm 12, and the bottom slice 32 is located under the supporting arm 12 for being soldered on the PCB. As the base slice 31 has a bigger height than that of the through slot 122 and the intervals are accordingly formed between the positioning member 30 and the supporting arm 12, those allow an up-and-down movement of the positioning member 30 so as to adjust a relative position of the PCB and the soldering portions 41, 51 of the terminals 40, 50 and further ensure the soldering portions 41, 51 capable of being always soldered with the PCB even when there is tolerance in production.

What is claimed is:

1. A connector for soldering to a PCB, comprising:

an insulating housing having a base of which two opposite ends extend frontward to form a pair of supporting arms, the supporting arm defining a through slot vertically penetrating through a top and a bottom thereof;

a plurality of terminals assembled in the base of the insulating housing, each of the terminals having a soldering portion projecting out of a bottom of the base for being soldered on the PCB; and a positioning member movably mounted to the supporting arm, the positioning member having a base slice received in the through slot, a top slice and a bottom slice extended from top and bottom edges of the base slice respectively and perpendicular to the base slice, the top slice being located on the top of the supporting arm and the bottom slice being located under the bottom of the supporting arm for being soldered on the PCB, wherein the base slice has a bigger height than that of the through slot, and intervals are accordingly formed between the supporting arm and the positioning member to achieve an up-and-down movement of the positioning member, so as to adjust a relative position between the PCB and the soldering portions of the terminals.

2. The connector as claimed in claim 1, wherein the top slice and the bottom slice are formed at the same side of the base slice.

3. The connector as claimed in claim 1, wherein the supporting arm has the bottom thereof substantially level with that of the base.

4. The connector as claimed in claim 1, further comprising a latch member having a base plate, a rear of the base plate extending rearward to form a fixing portion which is press fitted into a fixing recess opened in one end of the insulating housing, a portion of a top of the base plate adjacent to the fixing portion being bent outward and then extending downward to form a folded plate resting against a front side of the base for preventing the latch member further going into the fixing recess, the base plate being propped up by the supporting arm.

5. The connector as claimed in claim 4, wherein an outside of the top of the supporting arm protrudes upward to form a protrusion platform extending along the extension direction of the supporting arm to support the base plate of the latch member thereon.

6. The connector as claimed in claim 1, wherein the through slot penetrates a front end of the supporting arm.

* * * * *